United States Patent [19]

Tedrow

[11] 4,211,455

[45] Jul. 8, 1980

[54] TOOL BOX ACCESSORY CABINET

[76] Inventor: Joe E. Tedrow, 15900 Osborne St., Sepulveda, Calif. 91343

[21] Appl. No.: 40,547

[22] Filed: May 21, 1979

[51] Int. Cl.[2] ..... A47B 81/00; A47B 53/00; E05B 73/00

[52] U.S. Cl. ..... 312/198; 206/373; 211/60 T; 312/DIG. 33; 217/60 R; 220/4 B; 220/18; 220/375

[58] Field of Search ..... 312/198, DIG. 33, 245, 312/246, 206, 207, 280, 281; 206/349, 372, 373; 211/60 T; 217/60 R; 220/4 B, 18, 375

[56] References Cited

U.S. PATENT DOCUMENTS

| | | | |
|---|---|---|---|
| 1,471,712 | 10/1923 | Sohnle | 312/280 |
| 2,503,737 | 4/1950 | Hodgkins | 312/246 |
| 2,733,113 | 1/1956 | Humbargar | 312/DIG. 33 |
| 4,103,980 | 8/1978 | Silva | 312/245 |
| 4,155,458 | 5/1979 | Moline | 211/60 T |

*Primary Examiner*—Alexander Grosz
*Attorney, Agent, or Firm*—Jack C. Munro

[57] ABSTRACT

In combination with a tool box, a tool box accessory cabinet is secured to a side of the tool box. The accessory cabinet has a base which has therein a plurality of spaced-apart openings. Each opening is to accommodate an elongated tool which has an enlarged head. The enlarged head of the tool is to be located within the confines of the cabinet. The cabinet is to be lockable when closed and when open the top of the cabinet is to cooperate with the base to form an enlarged object supporting tray.

5 Claims, 4 Drawing Figures

Fig. 1
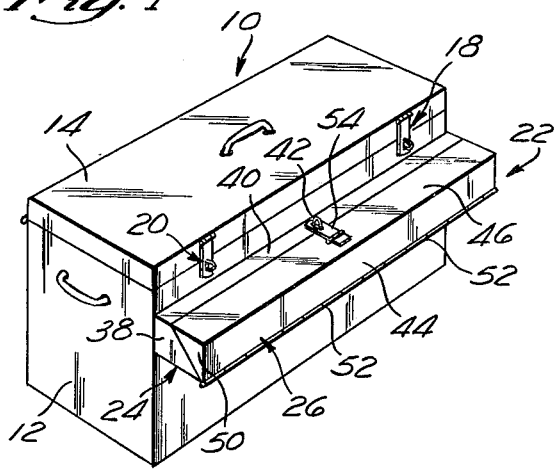
Fig. 2
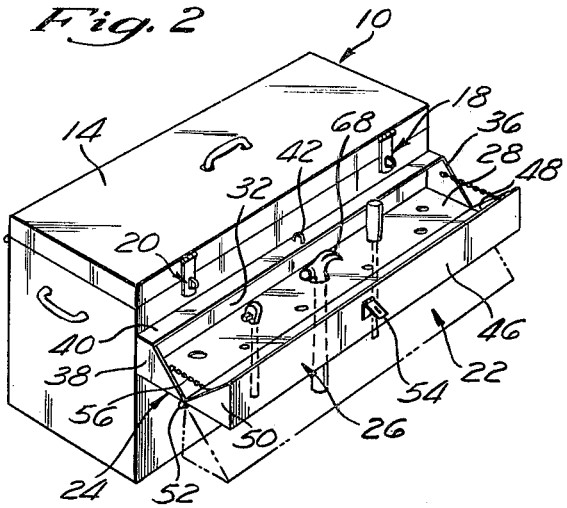
Fig. 3
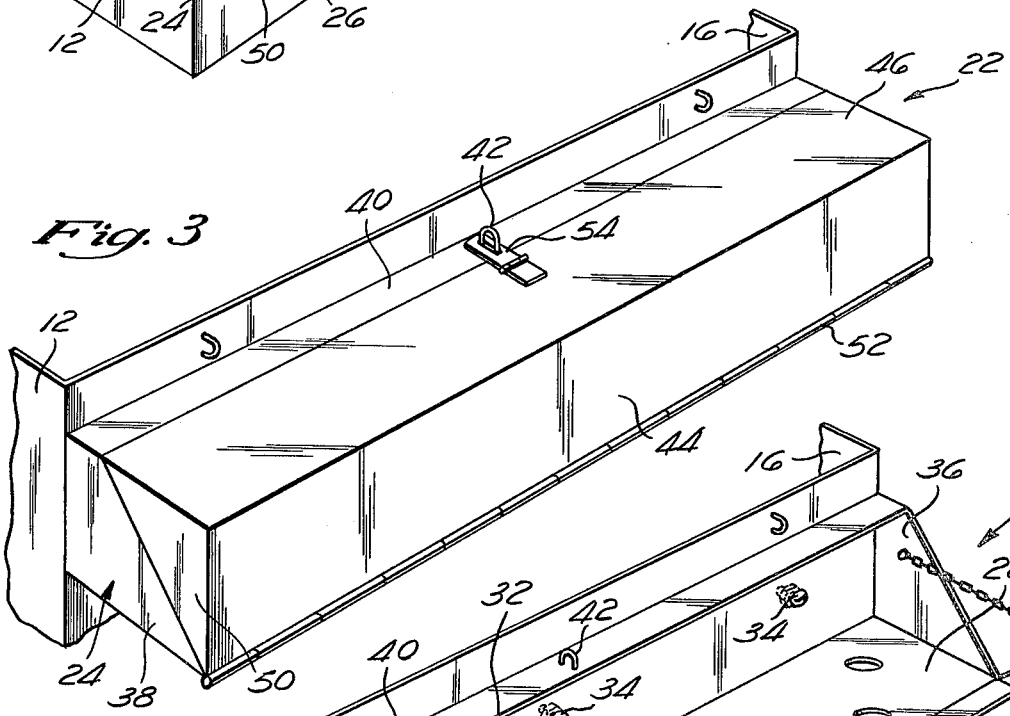
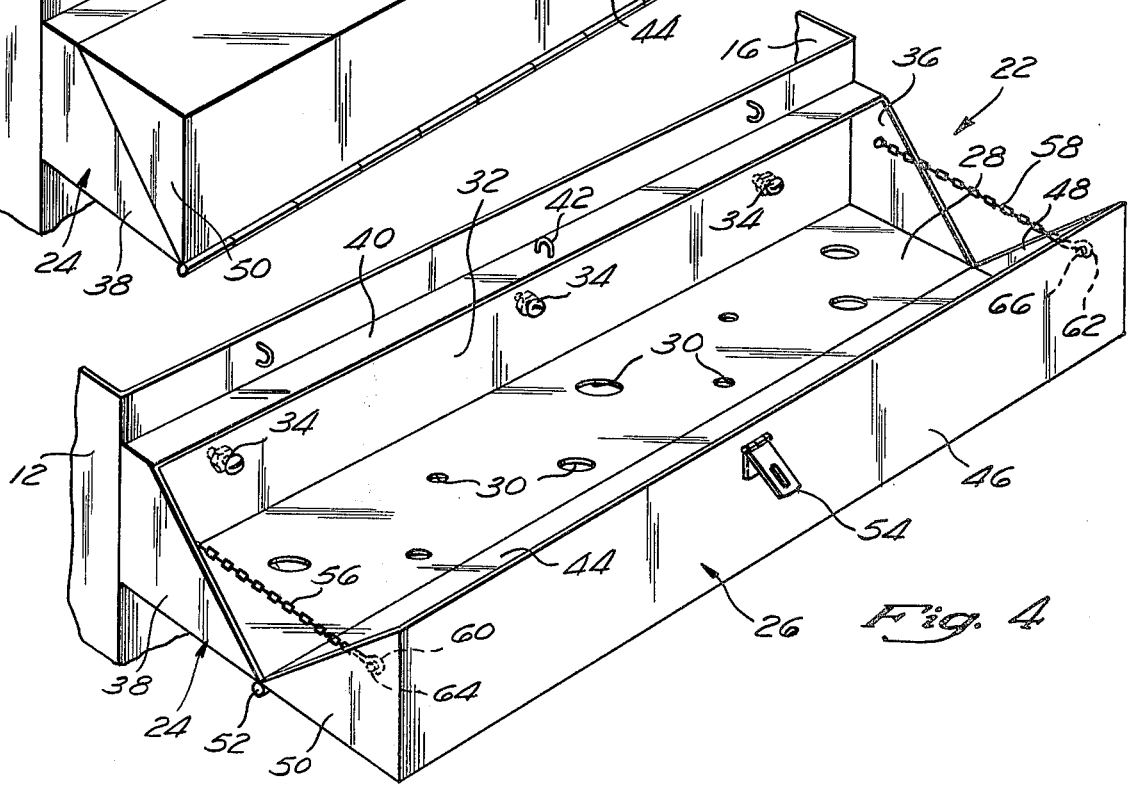
Fig. 4

TOOL BOX ACCESSORY CABINET

BACKGROUND OF THE INVENTION

Mechanics and other craftsmen usually purchase their own tools even when these individuals are employed by larger organizations. When the craftsman has completed his daily work, that person usually leaves the tool box at his place of employment. In order to insure that there will not be any thievery of the tools, the tool box is then locked by the owner of the tools.

Several common types of tools are of a substantial length, such as one foot or two feet or even longer. When these elongated type tools are distributed within the tool box, it is difficult at times to find other smaller tools. Also, it is difficult to remove certain smaller tools and to effect replacement within the tool box. The typical procedure is for the mechanic or craftsman to remove the elongated tools and place them on the floor or ground during the time the tool box is in use. This is undesirable since not only are the tools likely to get dirty, there is also a possibility that they might be stolen or not returned to the box. There is a need for a separate container which could be employed in conjunction with a conventional tool box which is to accommodate elongated tools.

SUMMARY OF THE INVENTION

The structure of this invention is summarily described in the Abstract of the Disclosure and reference is to be had thereto.

The primary objective of this invention is to construct a container for elongated tools which is to be mounted in conjunction with a conventional tool box and is to facilitate the quick and easy removal and replacement of the tools and also securely locks the tools to prevent unauthorized use.

A further advantage of this invention is that the structure can be manufactured inexpensively, therefore keeping the overall cost of the structure at a minimum.

BRIEF DESCRIPTION OF THE DRAWING

FIG. 1 is an isometric view of a conventional tool box upon which has been mounted on one side thereof the cabinet of this invention;

FIG. 2 is a view similar to FIG. 1 but showing the cabinet of this invention in the open position;

FIG. 3 is an enlarged isometric view of the cabinet of this invention as shown in FIG. 1 with the cabinet in the closed position; and FIG. 4 is a view similar to FIG. 3 but showing the cabinet in the open position.

DETAILED DESCRIPTION OF THE SHOWN EMBODIMENT

Referring particularly to the drawing, there is shown a conventional tool box 10 which is formed of a polygonal shaped housing 12 and a cover 14. The cover 14 is hingedly connected to the housing 12. The housing 12 includes an internal tool supporting chamber 16. The cover 14 is to be locked in the closed position by means of hasp assemblies 18 and 20.

Cabinet 22 of this invention is formed of an L-shaped (in cross-section) sheet material base 24 and an L-shaped (in cross-section) sheet material top 26. The base 24 includes a planar bottom member 28 which has a plurality of spaced-apart openings 30 formed therein. The base 24 also includes a back wall 32 which is fixedly secured to the trailing edge of the bottom member 28. The back 32 is to be bolted by conventional fastening means 34 to a wall of the tool chest 12.

Mounted on each end of the bottom member 28 are side walls 36 and 38. Between the side walls 36 and 38 and spaced from the bottom member 28 is a strip section 40. It is envisioned that the strip section 40 will normally be approximately one inch wide. Centrally mounted on the strip section 40 is a U-shaped bracket 42.

The top 26 includes front wall 44 and a top wall 46. At the ends of the top section 26 are formed side walls 48 and 50. The free edge of the front wall 44 is attached to the leading edge of the bottom member 28 by means of a hinge assembly 52. The hinge assembly 52 is deemed to be conventional and is what is commonly referred to as a "piano hinge". It is to be noted that in essence the actual configuration of the top 26 is basically similar to the configuration of the base 24 and when the two are assembled together in the closed position as shown within FIGS. 1 and 3, the side walls 38 and 50 and side walls 36 and 48 cooperate together to form in essence a solid member.

Mounted on the top wall 46 is a conventional hasp 54. The hasp 54 is to connect with the U-shaped bracket 42 to facilitate the locking of the cabinet 22 when in the closed position.

Fixedly secured on the inside surface of the side wall 38 is a first chain member 56. A second chain member 58 is fixedly secured on the inside surface of the side wall 36. The free ends of each of the chain members 56 and 58 are formed into a hook 60 and 62, respectively. The hook 60 is to cooperate with a pin 64 attached on the inside surface of the inside wall 50. In a similar manner, the hook 62 is to cooperate with the pin 66 attached on the inside surface of the side wall 48.

With the hooks 60 and 62 in engagement with their respective pins 64 and 66, the chains 56 and 58 are stretched taut and the front wall 44 is located in the same plane as the bottom member 28. In essence then, an enlarged tray has been formed which could be used as an additional storage area when the cabinet 22 is in the open position. Upon disengagement of the hooks 60 and 62 from their respective pins 64 and 66, the top section 26 could then be pivoted further to the phantom line position shown within FIG. 2 of the drawing. In this position, the tray has been eliminated which may be desirable at certain times.

It is to be understood that the operation of the cabinet 22 of this invention provides for the locating of a tool 68 within an opening 30. Although the handle portion of the tool 68 will extend exteriorly of the cabinet 22, upon the cabinet being in the closed position, removal of the tool 68 would be prevented. An individual may desire to place a padlock in conjunction with the U-shaped bracket 40 when the cabinet 22 is in the closed position in order to prevent thievery or other unauthorized removal of a tool 68.

What is claimed is:

1. In combination with a tool box, having a vertical sidewall a cabinet secured to said vertical sidewall, said cabinet comprising:

sidewalls connected to an elongated horizontal planar base having a leading edge and a trailing edge, a back attached at said trailing edge, said back being in contact with said vertical sidewall of said tool box, said base being in contact with said tool box, said base having a plurality of spaced-apart openings, each of said openings to connect with an elongated handle of a tool having an enlarged head with the enlarged head to be located against said base; and a top hingedly connected to said base at said leading edge, said top being movable between a closed position and an open position, said top having a front wall and a top wall, whereby with said top in said closed position, removal of a tool from a said opening is prevented while with said top in said open position the tools are capable of being removed.

2. The combination as defined in claim 1 wherein:

with said top in said open position said front wall is in the same plane as the plane of said base, whereby said front wall and said base function as a tray for supporting objects.

3. The combination as defined in claim 2 wherein:

stop means are interconnected between said top and at least one of the sidewalls of the cabinets said base, said stop means to locate said top in said open position.

4. The combination as defined in claim 3 wherein:

said stop means comprises at least a single length of chain which is stretched taut with said top in said open position, said chain being disconnectable to permit movement of said top to a further open position eliminating said tray.

5. The combination as defined in claim 4 including locking means on said cabinet adapted to deter unauthorized entry into said cabinet.

* * * * *